US005268723A

United States Patent [19]

Kikuchi

[11] Patent Number: 5,268,723

[45] Date of Patent: Dec. 7, 1993

[54] CLEANING MEMBER FOR CLEANING AN IMAGE TRANSFER MEMBER USED FOR TRANSFERRING AN IMAGE FORMED ON AN IMAGE BEARING MEMBER ONTO A RECORDING MEDIUM

[75] Inventor: Kazuhiko Kikuchi, Kanagawa, Japan

[73] Assignee: Kabushiki Kaisha Toshiba, Kawasaki, Japan

[21] Appl. No.: 933,299

[22] Filed: Aug. 21, 1992

[30] Foreign Application Priority Data

Aug. 23, 1991 [JP] Japan ..... 3-211844

[51] Int. Cl.[5] ..... G03G 15/14

[52] U.S. Cl. ..... 355/271; 15/256.51; 15/256.52; 355/273

[58] Field of Search ..... 355/271, 273, 274, 276, 355/297, 298, 301-303, 296; 15/256.51, 256.52

[56] References Cited

U.S. PATENT DOCUMENTS

| | | | |
|---|---|---|---|
| 4,026,648 | 5/1977 | Takahashi | 355/273 X |
| 4,530,597 | 7/1985 | Itaya et al. | 15/256.52 X |
| 4,998,143 | 3/1991 | Kumasaka et al. | 355/271 |
| 5,027,159 | 6/1991 | Oda et al. | 355/271 |
| 5,070,370 | 12/1991 | Bellis | 355/271 |
| 5,101,238 | 3/1992 | Creveling et al. | 355/271 |

FOREIGN PATENT DOCUMENTS

| | | | |
|---|---|---|---|
| 60-229079 | 11/1985 | Japan . | |
| 0298273 | 12/1988 | Japan | 355/302 |
| 0116677 | 5/1989 | Japan | 355/301 |
| 0109084 | 4/1990 | Japan | 355/301 |
| 3-131884 | 6/1991 | Japan . | |
| 2227974 | 8/1990 | United Kingdom | 355/301 |

*Primary Examiner*—A. T. Grimley
*Assistant Examiner*—Matthew S. Smith
*Attorney, Agent, or Firm*—Banner, Birch, McKie & Beckett

[57] ABSTRACT

An image forming apparatus includes a developing unit for developing a latent image formed on an image bearing member with a developing agent, an image transfer unit for transferring the developed image onto a recording medium. The image transfer unit includes a transfer member having a conductive and elastic member for frictionally engaging the recording medium and for pulling it between the image bearing member and the transfer member. The image forming apparatus of the present invention also includes a cleaning member for cleaning the transfer member. The cleaning member includes a plurality of projecting teeth for contacting the transfer member to remove toner and paper dust attached to the image transfer member. Thereby, the image forming apparatus can effectively clean the transfer member.

19 Claims, 11 Drawing Sheets

CLEANING MEMBER FOR CLEANING AN IMAGE TRANSFER MEMBER USED FOR TRANSFERRING AN IMAGE FORMED ON AN IMAGE BEARING MEMBER ONTO A RECORDING MEDIUM

BACKGROUND OF THE INVENTION

1. Field of the Invention

This invention relates to an image forming apparatus, such as an electrophotographic printer, for forming an image onto an image bearing member and, more particularly, to an image forming apparatus including an image transfer member for transferring an image onto a recording medium and including a cleaning member for cleaning the image transfer member.

2. Description of the Related Art

Generally, in conventional image forming apparatuses, a surface of an image bearing member, such as a photosensitive drum, is charged by a main charger. Exposing the surface of the drum with a light source creates a latent image on the charged photosensitive drum. A developing unit then develops the latent image using a development agent (toner) to create a visible image. Subsequently, the developed visible image is then transferred by an image transfer unit onto a recording medium such as a paper sheet.

Recently, many image transfer units utilize a transfer roller which contacts the photosensitive drum for transferring the image, formed on the drum, onto the paper sheet. For example, U.S. Pat. No. 5,010,370 discloses an image transfer unit having a transfer roller which is formed of a conductive and elastic outer layer (e.g., rubber). Also, Japanese Patent Disclosure (Kokai) No. 60-229079 discloses an image transfer unit having a transfer roller including at its periphery a conductive and elastic brush consisting of a plurality of bristles (e.g., carbon and nylon). Image transfer units utilizing transfer rollers are more desirable than transfer units utilizing a corona discharger in that corona production (e.g., ozone nitride) is not produced.

However, toner and paper dust are attracted to the surface of the transfer roller which has a conductive and elastic outer layer. The surface of the transfer roller must be designed to facilitate the removal of toner and paper dust to permit repeated use over a long period of time. Thus, the transfer roller is required to have a smooth surface with a low frictional resistance for facilitating its cleaning by a cleaning member. However, since the transfer roller's outer layer has a rough surface with a high frictional resistance, toner and paper dust will be strongly attracted to the conductive and elastic outer layer. Thus, in conventional image forming apparatuses, users are forced to frequently replace the transfer rollers to obtain a high quality image.

In another prior art embodiment, a transfer roller includes an outer layer formed of a material having a lower coefficient of friction. While it is easy to clean the surface of such a transfer roller, its lower frictional resistance will not effectively pull the recording medium between the transfer member and the image bearing member.

SUMMARY OF THE INVENTION

Accordingly, it is an object of the present invention to provide an image forming apparatus incorporating a cleaning member for sufficiently cleaning a conductive and elastic transfer member.

It is a further object of the present invention to provide a cleaning member having a simple construction.

It is another object of the present invention to provide an image forming apparatus including a transfer unit for transferring a high quality image onto a recording medium.

It is still a further object of the present invention to provide an image forming apparatus wherein it is not necessary to frequently replace the transfer roller.

Accordingly, the foregoing objectives, as well as others, are achieved in accordance with the present invention, by providing an image forming apparatus including a developing unit for developing a latent image formed on an image bearing member, and an image transfer member for transferring the developed image onto a recording medium. The image transfer member friction engages the recording medium for pulling it between the image bearing member and the image transfer member. The image forming apparatus also includes a cleaning member for cleaning the image transfer member. The cleaning member includes a plurality of projecting teeth for contacting the image transfer member to remove debris, such as residual developing agent and paper dust attached to the image transfer member.

A further aspect of the present invention is to provide an image forming apparatus including an exposure unit for forming a latent image on an image bearing member, a developing unit for developing the formed latent image with a developing agent, and a transfer roller for transferring the developed image onto a recording medium. The transfer roller includes a conductive and elastic outer layer (such as, for example, flexible bristles) for frictionally engaging the recording medium while the recording medium passes between the image bearing member and the transfer roller. The image forming apparatus also includes a cleaning member, for contacting and cleaning the transfer roller. The cleaning member has a conductive comb or rake-like member for removing any residual development agent and dust from the conductive and elastic member.

In accordance with another aspect of the present invention, the above-stated objects are achieved by providing an image forming method comprising the steps of: forming a latent image on an image bearing member, developing the latent image formed on the image bearing member with a developing agent, transferring the developed image onto a recording medium by a transfer member having a conductive and elastic outer layer for frictionally engaging the recording medium; and, cleaning the transferring member by utilizing a cleaning member having a plurality of projecting teeth for contacting the conductive and elastic outer layer to remove the developing agent attached to the outer layer.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein.

DETAILED DESCRIPTION OF THE PREFERRED EMBODIMENTS

Figure 1:
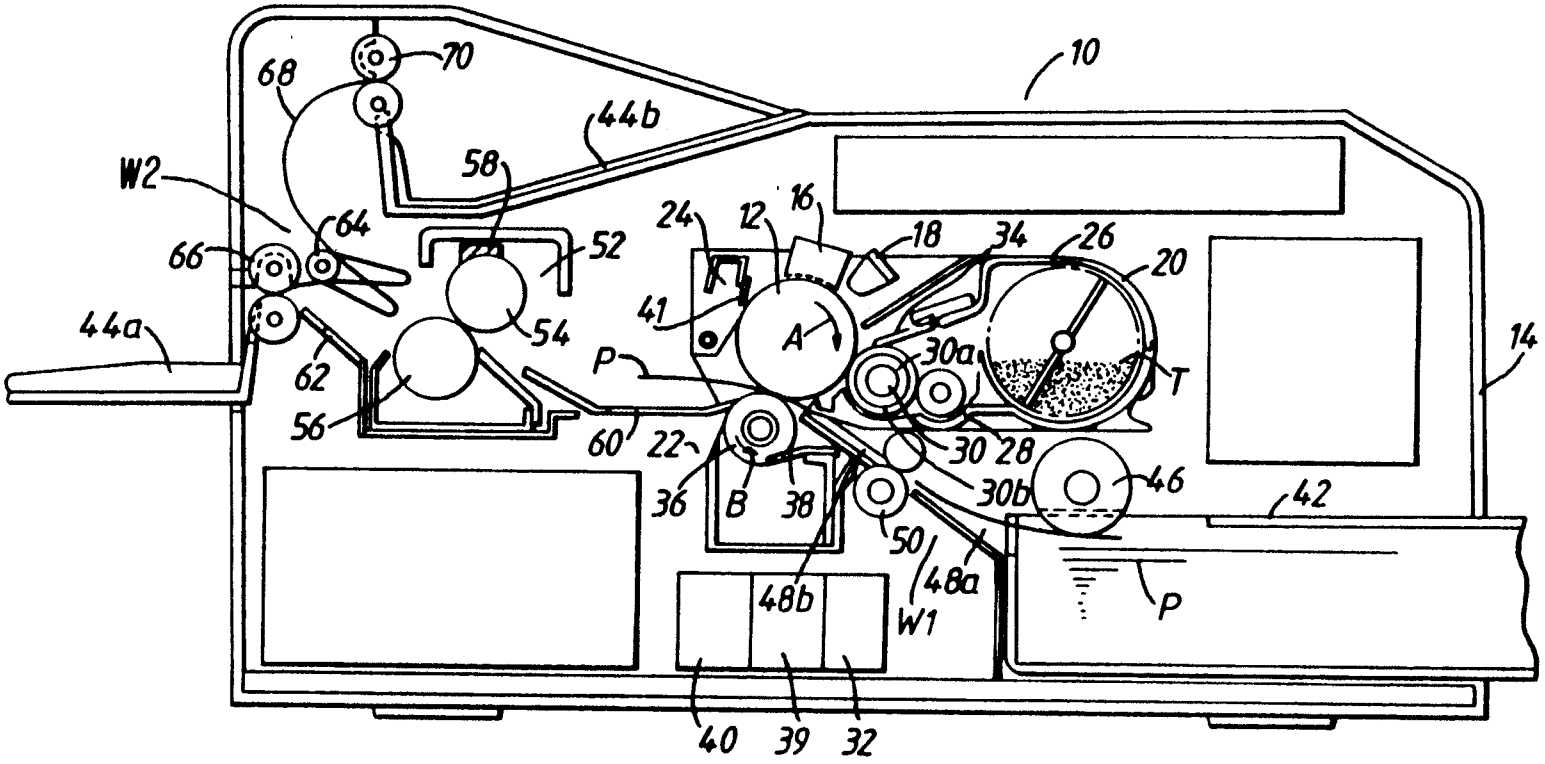
FIG. 1 is a sectional view of an image forming apparatus according to the present invention.

In the following detailed description, similar reference numerals will be used to denote similar elements in FIGS. 1 to 20.

FIG. 1 shows an image forming apparatus according to the present invention. The image forming apparatus may be one of a wide variety known in the prior art. For example, however, the image forming apparatus depicted is an electrophotographic printer. Electrophotographic printer 10 may serve as an output device for a host computer (not shown). In response to a print command from the host computer, printer 10 creates an image on a recording medium, for example paper sheet P, according to data supplied from the host computer.

Referring to FIG. 1, the internal construction of electrophotographic printer 10 will be described.

Electrophotographic printer 10 includes an image bearing member, for example, a photosensitive drum 12, for forming a latent image in response to light impinging onto its surface. Photosensitive drum 12, comprising an organic photoconductor (OPC), is disposed substantially in the center of a housing 14. Photosensitive drum 12 has a diameter of about 40 mm and is rotated, in the direction of arrow A, by an electric motor (not shown).

A charging unit 16, a latent image forming unit (an exposure unit) 18, a developing unit 20, an image transfer unit 22 and a cleaning unit 24, respectively, are arranged around the periphery of drum 12 in the direction of rotation.

Charging unit 16 charges the entire surface of photosensitive drum 12 to a uniform charge level for preparing the surface to form a latent image. For example, the peripheral surface of drum 12 is charged to −500 to −800 V by charging unit 16.

Latent image forming unit 18 then radiates a light beam onto drum 12. The beam exposes the charged area in accordance with the data received from the host computer. As a result, a latent image is formed on the surface of the drum.

Developing unit 20 develops the latent image with a developing agent for forming a visible image. Developing unit 20 includes a hopper 26, a toner feeding roller 28, and a developing roller 30. Hopper 26 stores non-magnetic toner T as a developing agent. Toner feeding roller 28 rakes toner T to prevent a cohesion of the toner and then transports it to developing roller 30. Developing roller 30 supplies the toner to photosensitive drum 12 and the latent image is thereby formed on the drum.

Developing roller 30 includes an elastic layer 30*a* and a conductive surface layer 30*b* surrounding elastic layer 30*a*, so that developing roller 30 is wholly elastic. Elastic layer 30*a* can comprise one or more of the following elastic materials: foamed polyurethane, silicon rubber, urethane rubber or diene rubber. Conductive surface layer 30*b* is formed of a conductive material having a resistance of $10^2$ to $10^8\Omega$.cm.

Developing roller 30 is electrically connected to a power source 32. Thus, a specified developing bias voltage of approximately −400 to −1400 V is applied to conductive surface layer 30*b* by a power source 32.

Developing roller 30 rotates in frictional contact with a friction blade 34 thus causing an electrostatic charge build-up. Blade 34 is formed of either phosphor bronze, polyurethane resin or silicon resin. Thus, toner T, supplied by developing roller 30, is charged as it passes between the surfaces of developing roller 30 and blade 34. A thin layer of toner T is thus attracted to the surface of developing roller 30.

Developing roller 30 contacts photosensitive drum 12 such that a nip width of 1 to 4 mm is formed by elastic deformation of developing roller 30, and a toner image is formed by the adherence of the toner to roller 30. In this case, toner T adheres to the area irradiated by the light beam.

Image transfer unit 22 transfers the developed image onto paper sheet P. Image transfer unit 22 includes a transfer roller 36 which faces photosensitive drum 12 at an image transfer position. Transfer roller 36 is rotated by an electric motor (not shown) in the direction of arrow B. Transfer roller 36 rotates in contact with the surface of photosensitive drum 12. Roller 36 contacts the reverse side of paper sheet P while it passes the image transfer position; as a result, the developed image formed on drum 12 is transferred to paper sheet P. Image transfer unit 22 also includes a cleaning member 38 for removing toner and paper dust attached to roller 36. Roller 36 is electrically connected to a power source 39 and cleaning member 38 is electrically connected to a power source 40.

Cleaning unit 24 removes residual toner from photosensitive drum 12 after transfer of the toner image by image transfer unit 22. Cleaning unit 24 includes an elastic blade 41 which contacts the surface of photosensitive drum 12 for scraping the residual toner from the surface of the drum.

A paper supply cassette 42 is inserted into a lower portion of housing 14. Cassette 42 holds a supply of paper sheet P. A first output tray **44*a* is located on the upper portion of housing 14 to receive printed paper sheets P from the output of printer 10. A second output tray 44*b* is located on a side of housing 14, so that second output tray 44*b*** may alternatively receive printed paper sheets P.

A pickup roller 46 for removing paper sheets P from cassette 42 is provided at the top end of cassette 42; roller 46 contacts the paper when cassette 42 is inserted into the housing 14. Pickup roller 46 has a semicircular cross-section and a flat surface. Paper sheet P, when removed from cassette 42, is then transported to the image transfer position along a feeding path W1. Feeding path W1 includes feeding guides **48*a* and 48*b* and a pair of aligning rollers 50**.

A fixing unit 52 is located downstream of the image transfer position. Fixing unit 52 fixes the toner image onto the paper by heating and pressing paper sheet P with the toner image. Fixing unit 52 includes a heating roller 54, a pressing roller 56 for pressing the paper against heating roller 54, and a cleaner 58 for cleaning the surface of heating roller 54.

A guide 60 is located between the image transfer position and fixing unit 52. Paper from the image transfer position is transported to fixing unit 52 along guide 60. An eject path W2 is located downstream of fixing unit 52. Eject path W2 ejects the paper with the fixed toner image onto output tray **44*a* or 44*b*. Eject path W2 includes a first guide 62, a gate 64, first pair of eject rollers 66, a second guide 68 and second pair of eject rollers 70. Gate 64 selects the eject position of paper sheet P with the fixed toner image. Both positions of gate 64 are shown, although in practice only one path is predetermined by controls external to housing 14. As a result, the paper is transported to output tray 44*a* and to output tray 44*b***.

Referring now to FIGS. 2 to 17, the details of image transfer unit 22 will be described.

Figure 2:
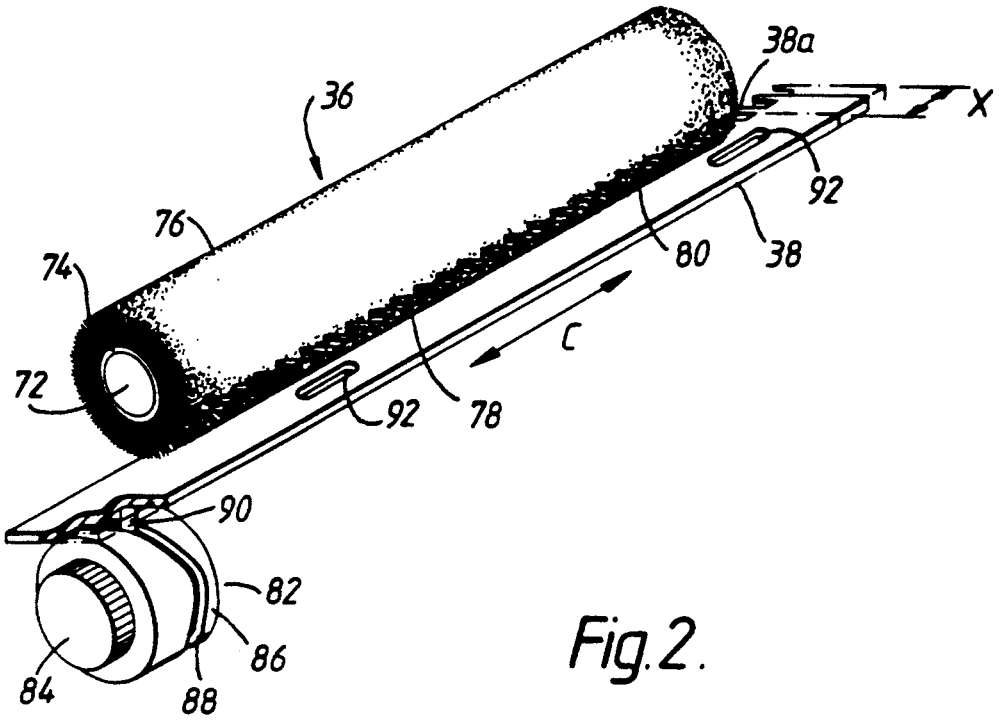
FIG. 2 is a perspective view of an image transfer unit shown in FIG. 1.

As described above, image transfer unit 22 includes transfer roller 36 which rotates in contact with the surface of photosensitive drum 12 for transferring the toner image formed on drum 12 onto paper sheet P. As shown in FIG. 2, transfer roller 36 includes a rotary cylinder 72, a conductive layer 74 and a conductive and elastic layer 76. Rotary cylinder 72 is formed of plastic or metal. Conductive layer 74 is formed by a conductive adhesive coating applied to rotary cylinder 72. Conductive and elastic member 76 frictionally engages paper sheet P while the paper passes between drum 12 and image transfer unit 22. Conductive and elastic member 76 has conductive fibers or bristles which are planted on rotary cylinder 72 through conductive layer 74 at a density of about 500 to 1,000 pcs./cm$^2$. Each of the conductive fibers is formed of conductive carbon and fiber (e.g., rayon, nylon etc.). Each of the conductive fibers has a surface conductivity of $10^5$ to $10^9\Omega$. cm, a length of approximately 3 to 15 mm, and a thickness of approximately 1 to 15 denier.

Transfer roller 36 is applied to a first positive AC bias voltage of approximately 800 to 2,000 V from power source 39 (see FIG. 1). This voltage is applied to conductive and elastic member 76. Thereby, the reverse side of paper sheet P receives a positive bias voltage by transfer roller 36. The toner image formed on the surface of photosensitive drum 12 is electrostatically attracted to paper sheet P by this bias voltage, and is thereby transferred onto the paper.

In the transfer unit 22 of the present invention, the toner from photosensitive drum 14 and the paper dust from paper sheet P are attached to conductive and elastic member 76 since transfer roller 36 contacts both the photosensitive drum 14 and paper sheet P. Thus, it is necessary to clean member 76 by removing the residual toner and paper dust to permit the repeated use of the transfer roller over a long period of time. Image transfer unit 22, therefore, includes cleaning member 38 for removing the toner and the paper dust attached to transfer roller 36. As shown in FIG. 2, cleaning member 38 includes a plate-shaped comb-like member **38*a* having a plurality of projecting teeth 78 and a plurality of spaces 80 therebetween. Each tooth 78 has a length of approximately 3 mm. Comb-like member 38*a* contacts conductive and elastic member 76 for removing the toner and the paper dust attached to conductive and elastic member 76. Cleaning member 38** is formed of a conductive member such as metal or conductive resin. For example, the conductive resin may be obtained by dispersing carbon or metal powder in acrylonitrile butadiene stene resin, polyacetal resin or polyurethane resin.

Cleaning member 38 is applied to a second AC bias voltage from power source 40 (see FIG. 1); this second bias voltage is higher than the first AC bias voltage applied to transfer roller 36. Thus, cleaning member 38 may effectively remove the toner and the paper dust from transfer roller 36.

In the present embodiment, the first AC bias voltage is a positive voltage. Thus, the toner is effectively removed from roller 36 to cleaning member 38 when the second bias voltage, higher than the first bias voltage, is applied to cleaning member 38. However, when the difference between the second bias voltage and the first bias voltage (hereinafter referred to as "the difference bias voltage") is too large, the removed toner will be charged; as a result, the charged toner will be transferred from cleaning member 38 to the reverse side of paper sheet P through transfer roller 36.

Figure 3:
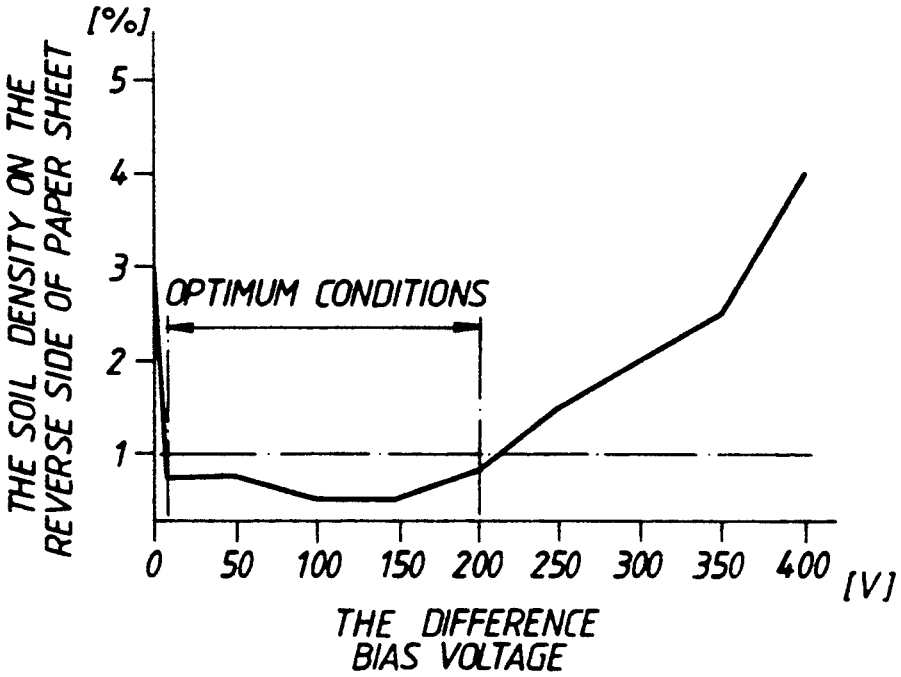
FIG. 3 is a graph showing the relationship between the soil density on the reverse side (i.e., non print side) of the paper sheet and the difference between the bias voltages applied to a transfer roller and the cleaning member of the transfer unit shown in FIG. 2.

Thus, the density of soil on the reverse side of paper sheet P was examined when the second bias voltage was changed. FIG. 3 shows the relationship between the soil density of reverse side of paper sheet P and the difference bias voltage. In this test, the first bias voltage was 1,000 V. When the difference bias voltage was about 10 V or more and about 200 V or less, the soil density on the reverse side of the paper was only 0.8% or less. Thus, in the case of a difference bias voltage of about 10 to 200 V, there was no significant effect in the transfer of toner of from cleaning member 38. However, when the difference bias voltage was about 10 V or less or about 200 V or more, the soil density on the reverse side of paper was about 1.0% or more. In this case, the reverse side of paper sheet P will be significantly soiled by the toner transferred from cleaning member 38.

Also, in this test, when a bias voltage of about 800 to 2,000 V was applied to transfer roller 36 and the second bias voltage changes, the same results were obtained.

Figure 4:
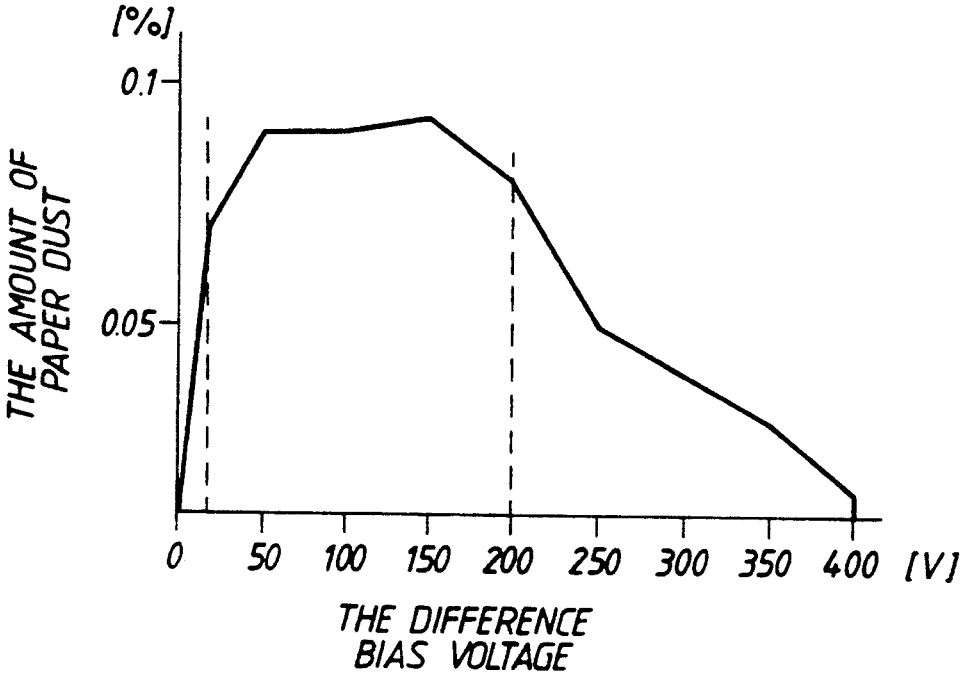
FIG. 4 is a graph showing the relationship between the amount of paper dust and the difference between the bias voltages applied to the transfer roller and the cleaning member of the transfer unit shown in FIG. 2.

FIG. 4 also shows the relationship between the amount of paper dust removed by cleaning member 38 and the difference bias voltage when the first bias voltage was 1,000 V and 10,000 sheets had been printed. In this test, the amount of the paper dust represents the ratio of paper dust to toner removed from transfer roller 36 by cleaning member 38. When the difference bias voltage was about 10 V or more and about 200 V or less, the amount of the paper dust removed by cleaning member 38 was about 0.075% or more. On the other hand, when the difference bias voltage was about 10 V or less, or about 250 V or more, the amount of paper dust removed by cleaning member 38 was about 0.05% or less. Thus, in the case of a difference bias voltage of about 10 to 200 V, the paper dust attached to transfer roller 36 may be effectively removed by cleaning member 38. In this test, when the first bias voltage of about 800 to 2,000 V was applied to transfer roller 36 and the second bias voltage applied to cleaning member 38 changes, the same results, as shown in FIG. 4, were also obtained. Therefore, in the present embodiment, the difference bias voltage is ideally set about 10 to 200 V.

Figure 5:
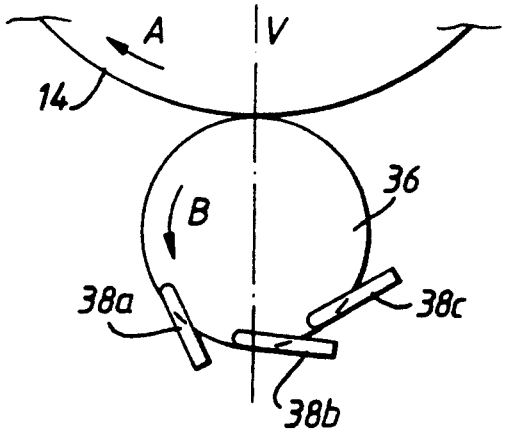
FIG. 5 is a sectional view of the various possible positions of the cleaning member shown in FIG. 2.

Referring to FIG. 5, alternative arrangement positions of cleaning member 38 will now be described. In the present embodiment, the cleaning effect was examined after 10,000 paper sheets had been printed. As shown in FIG. 5, first cleaning member 38A was located on the opposite side of drum 12 and along the upstream side, as indicated by rotational direction B, with respect to the vertical line V of transfer roller 36. Also, second and third cleaning members 38B and 38C were located on the opposite side of drum 12 and along downstream side, as indicated by rotational direction B, with respect to the vertical line V of transfer roller 36. Also third cleaning member 38C was located on the downstream side, as indicated by rotational direction B, with respect to second cleaning member 38B. In summary, cleaning member 36A was located at a 7 o'clock position along the rotational path of member 36 while cleaning members 38B and 38C were located at 6 o'clock and 5 o'clock positions, respectively.

In this case, teeth 78 (see FIG. 2) of first, second and third cleaning members 38A, 38B and 38C were alternatively arranged on the upstream side, as indicated by rotational direction B, on transfer roller 36. As a result of this test, it was found that more toner and paper dust was removed by member 38C than was removed by 38B; further, more toner and paper dust was removed by member 38B than was removed by 38A. Also, in the case of first cleaning member 38A, the image quality formed on paper sheet P was low, while the image quality in the case of second and third cleaning members 38B and 38C were respectively higher.

Thus, in the present embodiment, cleaning member 38 should be ideally positioned at either **38*b* or 38*c* (i.e., approximately 6 o'clock or 5 o'clock); that is, positioned on the opposite side to photosensitive drum 14** and along the downstream side, as indicated by rotational direction B, with respect to the vertical line V.

Figure 6:
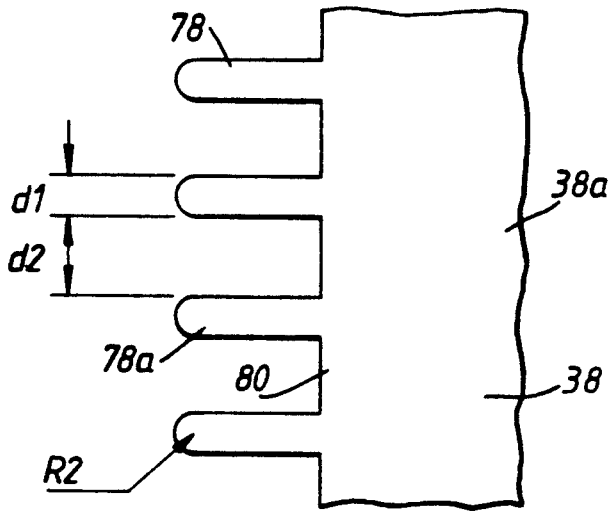
FIG. 6 is a plan view, partly in section, of a comb-like member of the cleaning member shown in FIG. 2.

Next, comb-like member **38*a* of cleaning member 38 will be described referring to FIGS. 6 to 13. As described above, cleaning member 38 includes comb-like member 38*a* having a plurality of projecting teeth 78 with a plurality of spaced portions 80 therebetween. As shown in FIG. 6, each tooth 78 has a width d1 which are spaced from each other by an amount d2. In the present embodiment, if each tooth 78 has a large width, the deformations of conductive and elastic member 76, as it contacts convex portions 78*a***, will become large. Thus, the image formed on paper sheet P will have a low quality.

Figure 7:
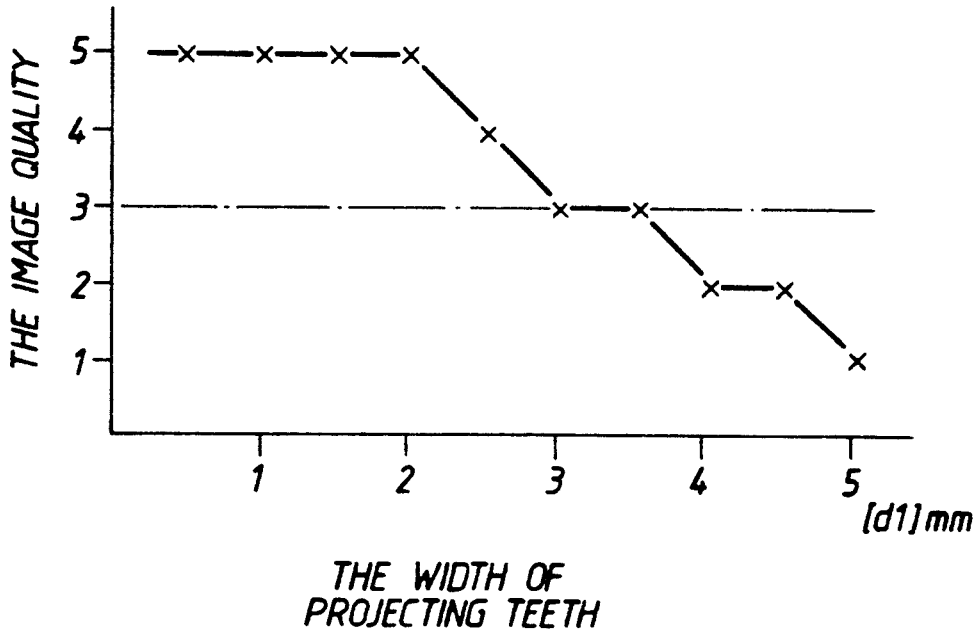
FIG. 7 is a graph showing the relationship between image quality and the width of the projecting teeth of the comb-like member shown in FIG. 6.

Thus, the image quality was examined after 100,000 sheets had been printed using a plurality of cleaning members, each having different tooth widths. FIG. 7 shows the results of this test. In the case of teeth having a width (d1) of 3.5 mm or less, the images formed on the paper had respectively higher quality. In the present invention, therefore, it is preferred to select a width (d1) of about 3.5 mm or less, so as to form a toner image of high quality.

Figure 8:
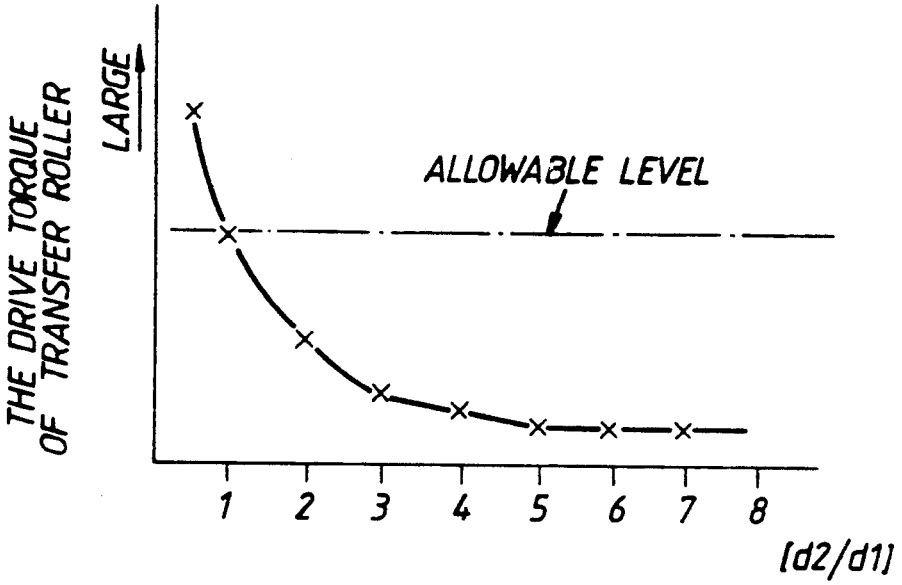
FIG. 8 is a graph showing the relationship between the drive torque of the transfer roller shown in FIG. 2 and the ratio of the spacing of the projecting teeth to the width of the projecting teeth shown in FIG. 6.

Also, when the ratio of width (d2) of spaced portions 80 to the width (d1) (hereinafter referred to as a "d2/d1") is too small, a greater frictional force will be created between the bristles 76 of transfer member 36 and the cleaning member. Thus, the drive torque of transfer roller 36 will increase and a tensile stress on conductive and elastic member 76 will be created; as a result, the bristles or fibers of 76 may be broken. FIG. 8 shows the relationship between the drive torque of transfer roller 36 and d2/d1. In the comb-like member **38*a* of the present invention, d2/d1 is preferably about 1.0 or more, for preventing the drive torque of transfer roller 36** from increasing too significantly.

Figure 9:
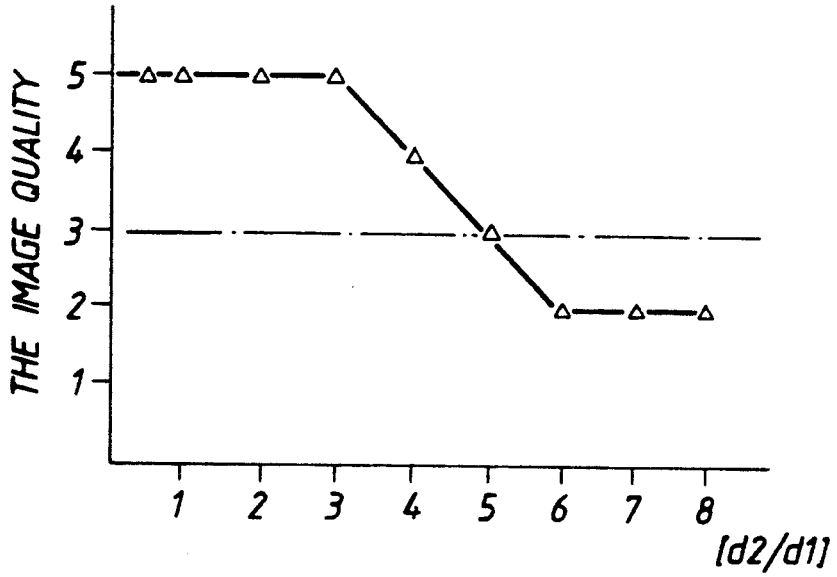
FIG. 9 is a graph showing the relationship between image quality and the ratio of the spacing of the projecting teeth to the width of the projecting teeth shown in FIG. 6.

On the other hand, when d2/d1 is too large, then the number of teeth contacting conductive and elastic member 76 will decrease, resulting in ineffective cleaning action. Thus, cleaning member 38 will not effectively remove the toner and paper dust attached to conductive and elastic member 76. FIG. 9 shows the relationship between the image quality and d2/d1. In FIG. 9, the image quality is indicated by the levels (1-5) which corresponds to a change in measured image density as shown in the following table:

TABLE 1

| Level | The image density changes | The quality of image |
|---|---|---|
| 5 | 0–0.02 | Good |
| 4 | 0.02–0.05 | Good |
| 3 | 0.05–0.10 | Normal |
| 2 | 0.10–0.20 | Poor |
| 1 | 0.20– | Poor |

In the case of levels 4 and 5, the image quality of the toner images are respectively good. In the case of level 3, the image quality is normal. However, in the case of levels 1 and 2, the image quality are respectively poor. Referring to FIG. 9, when d2/d1 was about 4.0 or less, the image quality was good. Also, in the case of d2/d1 of about 5.0, the image quality was normal. However, when d2/d1 was 6.0 or more, the image quality was low.

Therefore, in comb-like member 38*a* of the present embodiment, d2/d1 is preferably about 5.0 or less. As previously discussed, if d1 is preferably about 3.5 mm or less, each spaced portion 80 of cleaning member 38 has a width d2 of about 17.5 mm or less. Further, d2/d1 is preferably about 4.0 or less so as to form a high quality toner image.

Figure 10:
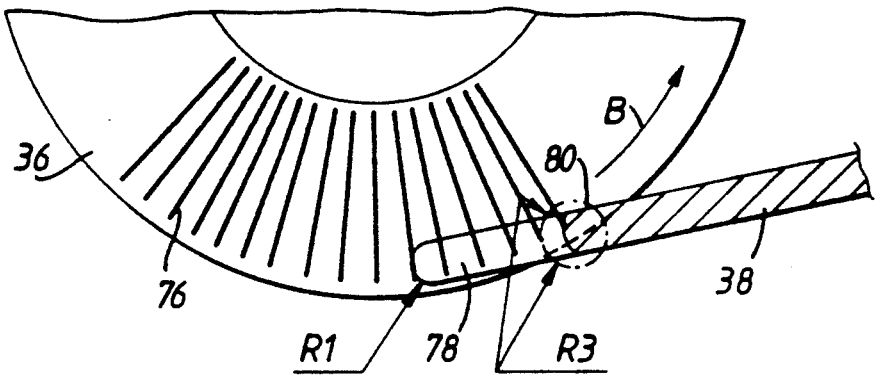
FIG. 10 is a sectional view showing the functional relationship between the transfer roller and the cleaning member shown in FIG. 2.

As shown in FIG. 10, both teeth portions 78 and spaced portions 80 contact conductive and elastic member 76 of transfer roller 36. The toner and the paper dust attached to member 76 are disengaged by teeth 78 and the released toner and paper dust are removed from member 76 by spaced portions 80 in combination with mechanical vibration.

Referring again to FIGS. 6 and 10, the top portions of teeth 78 include a curved surface 78*a* which has a first curvature R1 in a direction perpendicular to the axis of movement of the cleaning member 38 and a second curvature R2 in a direction along the axis of movement of cleaning member 38. Also, each spaced portion 80 includes a curved surface which has a third curvature R3 in a direction perpendicular to the axis of movement of cleaning member 38. When top portions 78*a* of teeth 78 and spaced portions 80 have sharp surfaces, the conductive fibers of member 76 may break while member 76 contacts cleaning member 38 over a long period of time. Thus, it is desirable for portions 78*a* and spaced portions 80 to have a curved surface for preventing such breakage.

Figure 11:
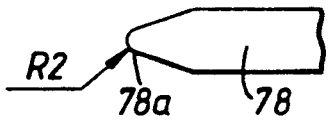
FIGS. 11(*a*) to (*c*) are plan views, partly in section, of the various types of projecting teeth that can be utilized for the cleaning member shown in FIG. 6.
Figure 11:
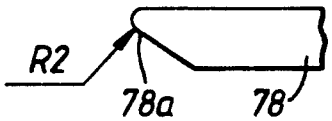
Figure 11:
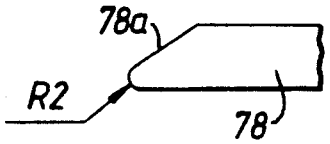

FIGS. 11(*a*) to 11(*c*) show examples of different shapes for the curved surfaces of top portion 78*a* of teeth 78. As a result, conductive and elastic member 76 may be smoothly moved from top portion 78*a* to spaced portion 80 when transfer roller 36 contacts cleaning member 38. This prevents the bending of the conductive fibers by cleaning member 38.

Figure 12:
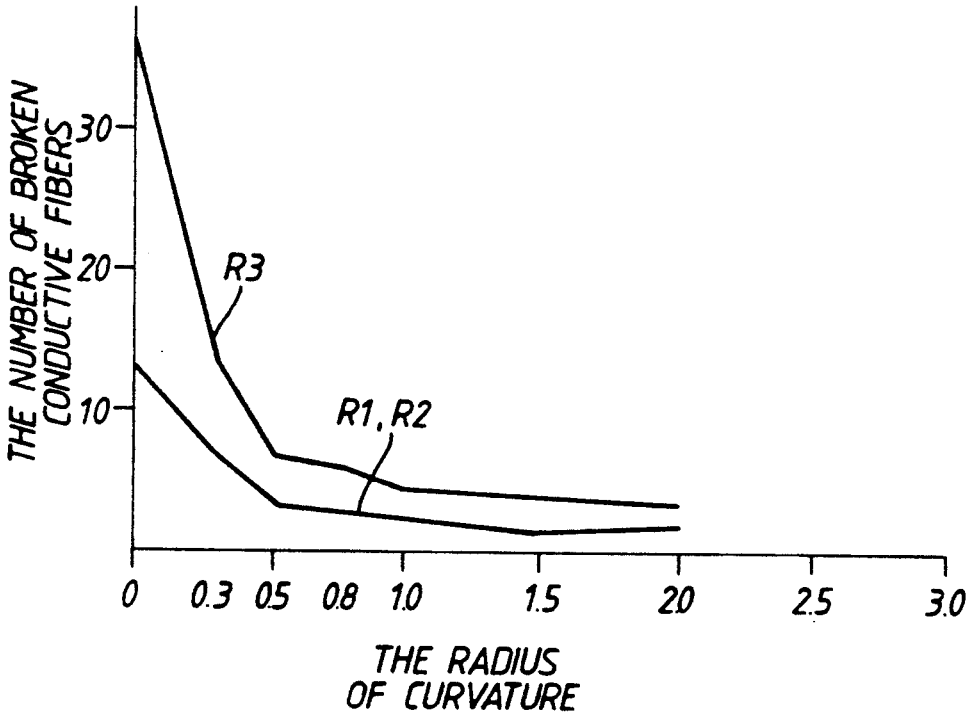
FIG. 12 is a graph showing the relationship between the number of broke conductive fibers of the transfer roller shown in FIG. 2 and the radius of curvature of the cleaning member teeth shown in FIGS. 10 and 11.

The number of broken conductive fibers was examined after transfer roller 36 was rotated at about 30 rpm for 10 hours using cleaning members having different radius of curvatures. FIG. 12 shows the relationship between the number of broken conductive fibers and the radius of curvatures (R1, R2 and R3) of cleaning member 38. As a result, as the first, second and third curvatures (R1, R2 and R3) were respectively increased from 0.5, the number of broken conductive fibers decreased. Thus, it is preferable to have curvatures of about 0.5 mm or more, in order to prevent the breakage of the fibers.

Figure 13:
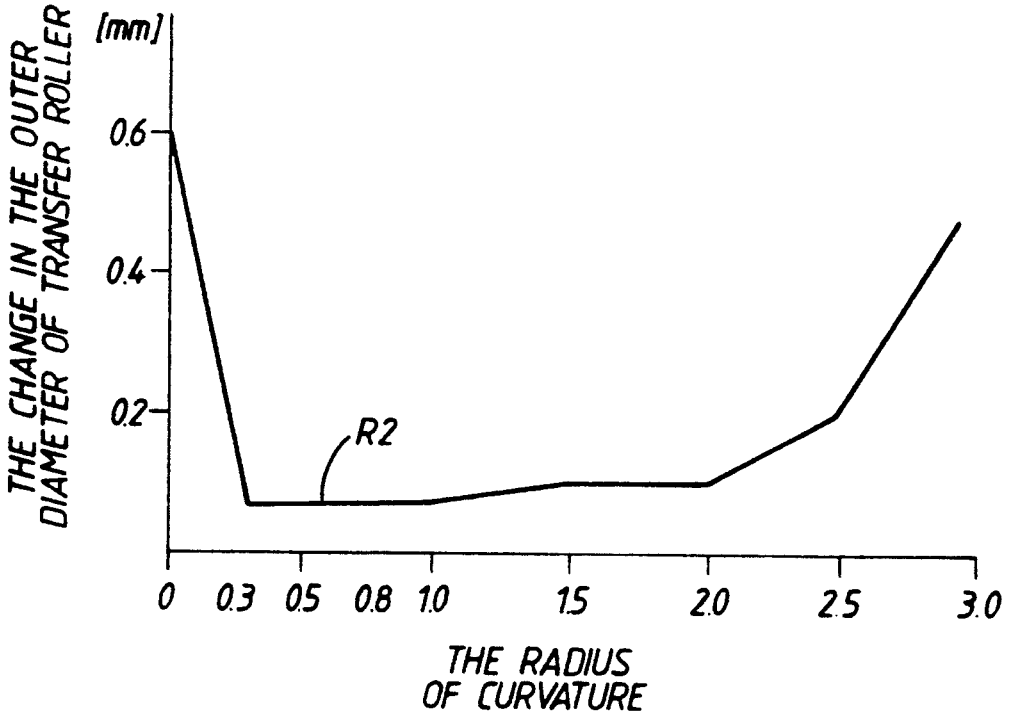
FIG. 13 is a graph showing the relationship between the change in the outer diameter of a brush type transfer roller shown in FIG. 2, due to breakage of bristles, and the radius of curvature of the cleaning member teeth shown in FIGS. 10 and 11.

When the second curvature (R2) of cleaning member 38 is made sufficiently large or small, the conductive fibers will easily bend. The change in the outer diameter of a brush type transfer roller 36 having an outer diameter of about 16 mm was examined after the roller was rotated for 10 hours at approximately 30 rpm and for 10 hours by using a plurality of cleaning members having different second curvatures (R2). FIG. 13 shows the relationship between the change in the outer diameter of a brush type roller 36 and the radius of second curvature (R2). As can be seen, second curvature (R2) is preferably in the range of 0.3 to 2.0 mm, in order to prevent the conductive fibers from bending. In the present embodiment, therefore, first and third curvatures R1 and R3 are preferably greater than or equal to 0.5 and second curvature R2 is preferably in the range of 0.5 to 2.0 mm.

Figure 14:
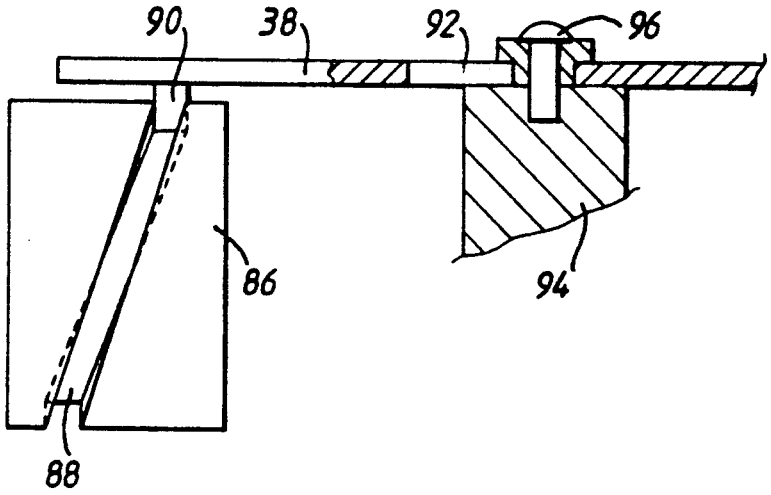
FIG. 14 is a partial sectional front view of the cleaning member shown in FIG. 2.
Figure 15:
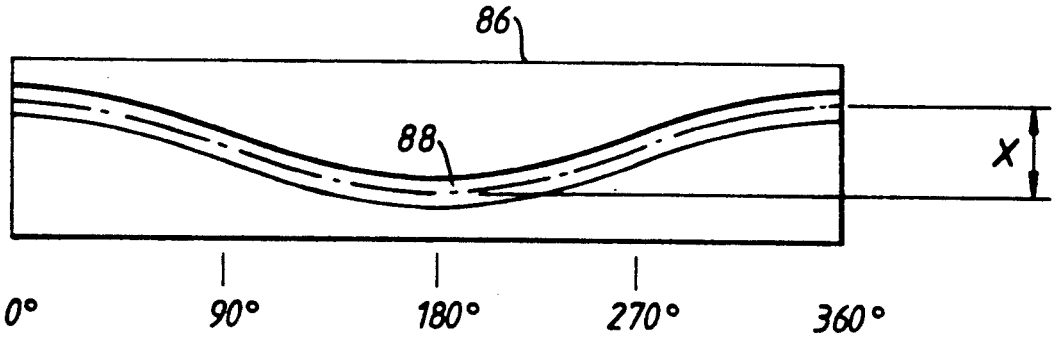
FIG. 15 is a planar projection of cam track 88 of the cleaning member shown in FIG. 2 which provides the reciprocal movement of the cleaning member.

Referring again to FIG. 2, image transfer unit 22 further includes a reciprocating member 82 for providing the reciprocal movement of cleaning member 38 along the axial direction C. Reciprocating member 82 has a gear 84 and a cylindrical cam 86 connected to gear 84. Gear 84 is driven by a motor (not shown). Cylindrical cam 86 has a cam track 88 provided on the circumference thereof and formed in the shape of a sine wave. A cam follower 90 is provided on an end of cleaning member 38. Cam follower 90 is received into cam track 88 of member 82. Cleaning member 38 also includes a plurality of holes 92 spaced along the axial direction C of transfer roller 36. As shown in FIG. 14, cleaning member 38 is secured onto housing 94 of image transfer unit 22 by a screw 96 through holes 92. Thereby, cleaning member 38 may reciprocate along the axial direction C of transfer roller 36. Thus, one rotation of cam 86 causes cleaning member 38 to reciprocate between two positions separated by a distance X.

Figure 16:
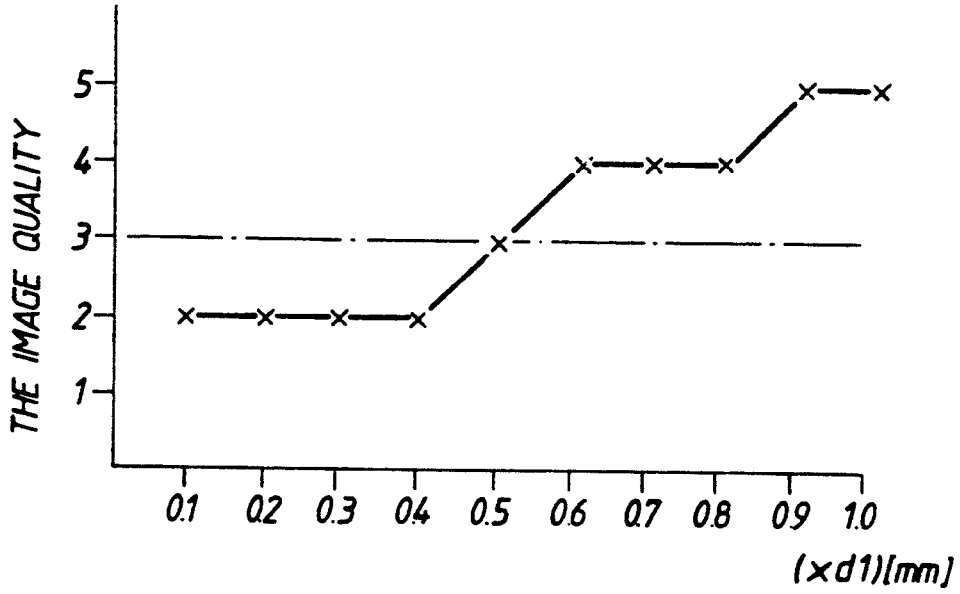
FIG. 16 is a graph showing the relationship between the image quality and the degree of reciprocal movement of the cam follower along the cam track of the cleaning member shown in FIG. 2.

In the present embodiment, the movement of cleaning member 38 may be adjusted by changing the amplitude of the sine wave of cam track 88. The period of cleaning member 38 may be adjusted by changing the revolution of gear 84 or by changing the period of the sine wave. The image quality of the toner image was examined after printing 10,000 paper sheets while changing the amplitude of cleaning member 38. FIG. 16 shows the results of this test. As a result, when the amplitude of cleaning member was about dl/2 or more, the images produced were of higher quality.

Figure 17:
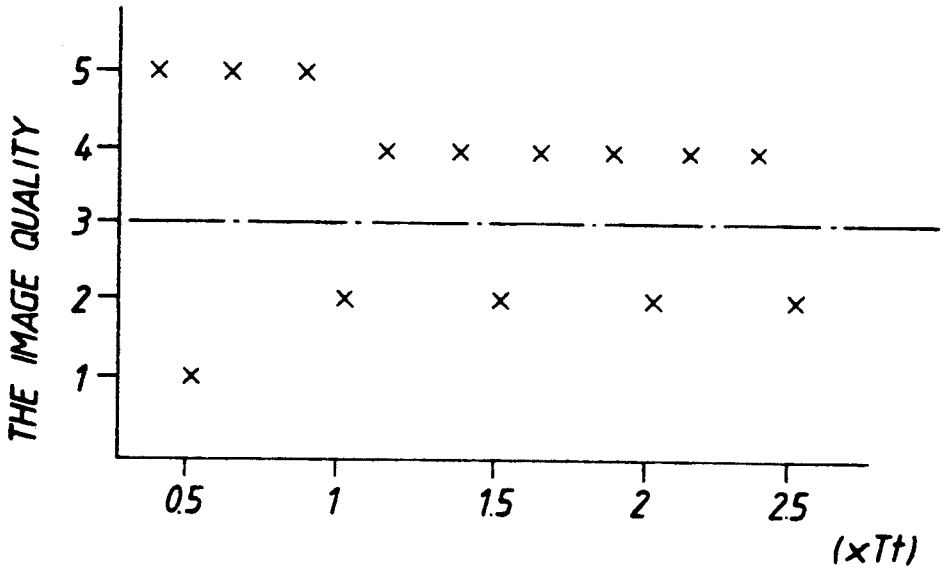
FIG. 17 is a graph showing the relationship between image quality and the rotational speed of cam 86 of the cleaning member shown in FIG. 2.

The quality of toner image was also examined after printing 10,000 paper sheets while changing the period of cleaning member 38. FIG. 17 shows the results of this. In FIG. 17, Tt represents the period of rotation of transfer roller 36. When the period of cleaning member 38 was respectively set at the integral multiples of Tt/2, the conductive fibers appeared to bend more easily. Thus, the images were of lower quality. As a result, in the present embodiment, the amplitude of cleaning member 38 is preferably selected to be at least approximately dl/2, for preventing the fibers from bending and, thereby, creating a high quality image. Also, it is desirable not to select a period of cleaning member 38 at the integral multiple of Tt/2.

Figure 18A:
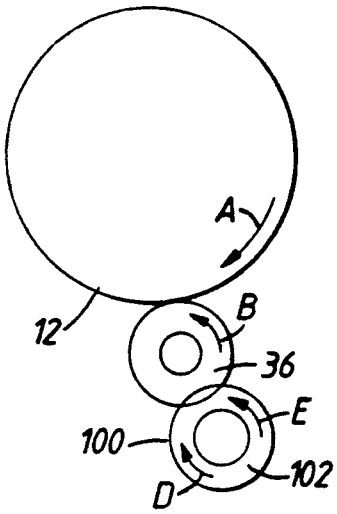
FIGS. 18(*a*) to (*b*) are sectional views of another embodiment of the cleaning member shown in FIG. 1.
Figure 18B:
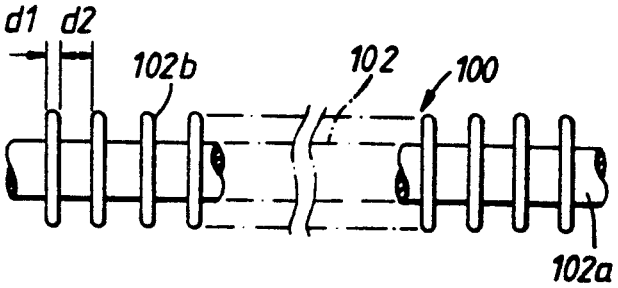

Shown in FIGS. 18(*a*) and 18(*b*) is another embodiment of the present invention. Here image transfer unit 22 includes a cleaning member 100 having a roller 102 with annular shaped comb projections. Roller 102 includes a rotary cylinder 102*a* and a plurality of annular shaped comb projections 102*b* spaced along the outer surface of rotary cylinder 102*a*. Roller 102 is formed of a conductive member such as metal or conductive resin similar to cleaning member 38. In this embodiment, the width d1 of projection 102*b* is preferably about 3.5 mm or less and d2/d1 is preferably about 5.0 or less in order to form a high quality toner image. Projection 102*b* extends radially approximately 3 mm or more from the surface of cylinder 102*a*.

Cleaning member 100 is rotated by a motor (not shown) at a predetermined rotational speed. When cleaning member 100 is rotated at a speed lower than transfer roller 36, cleaning member 100 will not remove the toner and the paper dust from roller 36. On the other hand, when cleaning member 100 is rotated at a speed higher than transfer roller 36, the toner, removed from roller 36, will flow from cleaning member 100, thereby soiling the paper sheets.

Figure 19:
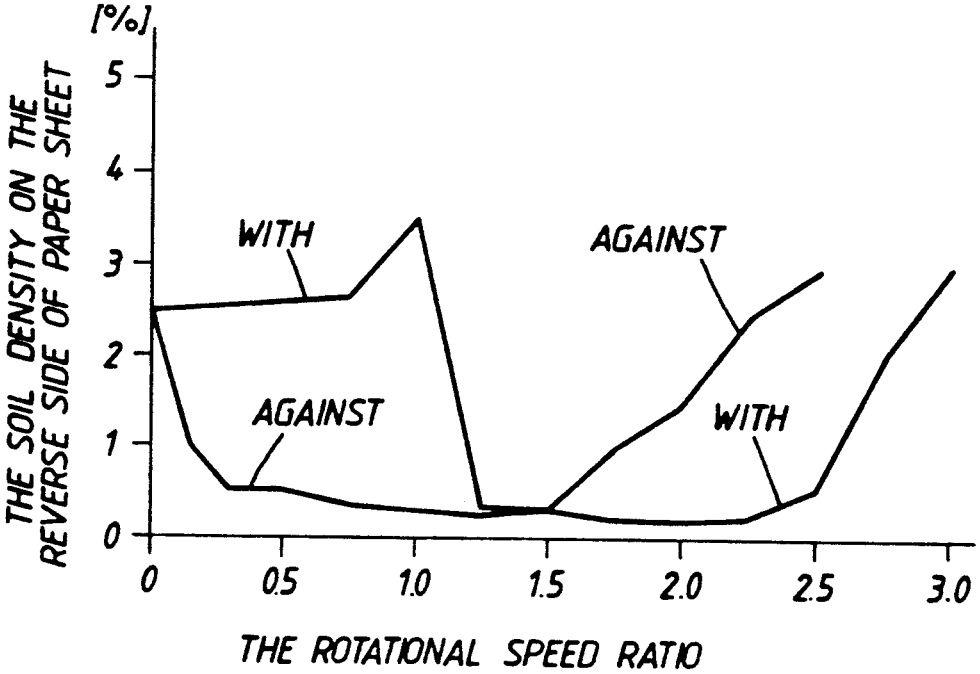
FIG. 19 is a graph showing the relationship between the soil density on the reverse side of the paper and the rotational speed ratio of the cleaning member to the transfer roller shown in FIG. 18.
Figure 20:
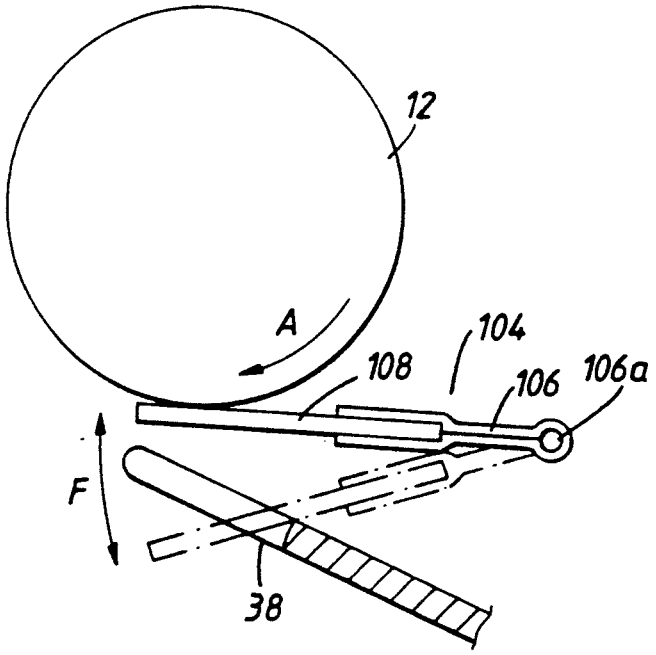
FIG. 20 is a sectional view of a further embodiment of the image transfer unit shown in FIG. 1.

Thus, the quality of image was examined when cleaning member 100 was rotated at a plurality of rotational speeds. FIG. 19 shows the relationship between the soil density on the reverse side of paper sheet P and the rotational speed ratio of cleaning member 100 to transfer roller 36. In this test, transfer roller 36 was rotated at 70 mm/sec and cleaning member 100 was applied with a bias voltage of 200 V. As a result, when cleaning member 100 was rotated in the direction D (i.e., in the opposite direction B of transfer roller 36) and the rotational speed ratio was about 0.3 to 1.5, the soil density on the reverse side of paper sheet P was 0.5% or less. When cleaning member 100 was rotated in the direction E (i.e., in the same direction B of transfer roller 36) and the rotational speed ratio was about 1.2 to 2.5, the soil density in the reverse side of paper sheet P was 0.5% or less.

Thus, in the present embodiment, when cleaning member 100 is rotated in direction D, the rotational speed ratio is preferably set about 0.3 to 1.5 in order to form a high quality image. Also, when cleaning member 100 is rotated in direction E, the rotational speed ratio is preferably set about 1.2 to 2.5.

In the embodiments described above, image transfer unit 22 includes transfer roller 36. Alternatively, as showing in FIG. 20, image transfer unit 22 may be provided with (for example) a plate-shaped transfer member 104 having a support member for supporting a conductive and elastic member 108. Support member 106 is made of a conductive member, for example, aluminum, stainless steel or the like. Conductive and elastic member 108 is made of conductive fibers which are attached to support member 106. Each of the conductive fibers is formed of conductive carbon and a fiber (e.g., rayon or nylon), in a manner similar to conductive and elastic member 76 of transfer roller 36. Plate-shaped transfer member 104 may be rotated in the direction of arrow F about a pivot 106*a*. As a result, conductive and elastic member 108 will be forced into contact with the surface of photosensitive drum 12 and cleaning member 38. In this embodiment, conductive and elastic member 108 is urged into contact with cleaning member 38 while image transfer unit 22 is not operating.

The cleaning member according to the present invention is applicable to many types of image forming apparatus such as electrophotographic copying machines and facsimile apparatuses, and is not limited to laser printing.

It should be understood that the detailed description and exemplary embodiments, which indicate presently preferred embodiments of this invention, are given by way of illustration only. Various modifications and changes may be made to the present invention, without departing from the scope or spirit of the invention, as set forth in the following claims.

I claim:

1. An image forming apparatus comprising:

developing means for developing a latent image formed on an image bearing member to produce a developed image;

transferring means for transferring said developed image onto a recording medium, wherein said transferring means engages said recording medium while said recording medium is passed between said image bearing member and said transferring means;

cleaning means for cleaning said transferring means, said cleaning means including a plurality of projections for contacting said transferring means to remove debris attached to said transferring means;

first means for applying a first bias voltage to said transferring means; and second means for applying a second bias voltage which is approximately 20 to 200 volts higher than said first bias voltage to said cleaning means.

2. The image forming apparatus of claim 1 wherein said projections comprise a plurality of projecting teeth.

3. An image forming apparatus comprising:

developing means for developing a latent image formed on an image bearing member to produce a developed image;

transferring means for transferring said developed image onto a recording medium, wherein said transferring means engages said recording medium while said recording medium is passed between said image bearing member and said transferring means, said transferring means including at its periphery a conductive and elastic brush having a plurality of bristles;

cleaning means for cleaning said transferring means, said cleaning means including a plurality of projections formed into a plate-shaped comb-like member for contacting said transferring means to remove debris attached to said transferring means; and means for moving said comb-like member with respect to said transferring means.

4. The image forming apparatus of claim 3 wherein said moving means moves said comb-like member in a reciprocal manner.

5. An image forming apparatus according to claim 4, wherein said moving means includes first adjusting means for changing the amplitude of reciprocal movement of said cleaning means and second adjusting means for changing the period of reciprocal movement of said cleaning means.

6. An image forming apparatus according to claim 5, wherein said first adjusting means includes a cylindrical cam having a cam track provided on the circumference thereof and formed in the shape of a sine wave; and said cleaning means includes a cam follower which is received into said cam track, whereby the rotation of said cylindrical cam provides the reciprocal movement of said cleaning means.

7. An image forming apparatus comprising:

developing means for developing a latent image formed on an image bearing member to produce a developed image;

transferring means for transferring said developed image onto a recording medium, wherein said transferring means engages said recording medium while said recording medium is passed between said image bearing member and said transferring means, wherein said transferring means comprises a rotational cylinder having an outer layer, said outer layer of said rotational cylinder including a conductive and elastic material; and cleaning means for cleaning said transferring means, said cleaning means including a plurality of annular shaped comb projections for contacting said transferring means to remove debris attached to said transferring means and including a rotary cylinder, wherein the rotational speed ratio of said rotary cylinder to said transferring means is about 1.2 to 2.5 when said rotary cylinder is rotated in the same direction as said transferring means or about 0.3 to 1.5 when said rotary cylinder is rotated in a direction opposite to said transferring means.

8. An image forming apparatus according to claim 7, wherein each annular shaped comb projection has a width of about 3.5 mm or less.

9. An image forming apparatus according to claim 8, wherein said plurality of teeth includes a plurality of spaced portions therebetween; and each of said spaced portions has a width of about 17.5 mm or less.

10. An image forming apparatus according to claim 9, wherein each of said spaced portions includes a curved surface for contacting said transferring means.

11. An image forming apparatus according to claim 10, wherein said curved surface includes a third curvature in a direction perpendicular to an axis of movement of said cleaning means.

12. An image forming apparatus according to claim 11, wherein said third curvature is about 0.5 mm or more.

13. An image forming apparatus according to claim 7, wherein each of said annular shaped comb projections includes a top portion having a curved surface for contacting said transferring means.

14. An image forming apparatus according to claim 13, wherein said curved surface includes a first curvature in a direction perpendicular to an axis of movement of said cleaning means and a second curvature in a direction along the axis of movement of said cleaning means.

15. An image forming apparatus according to claim 14, wherein said first curvature is about 0.5 mm or more and said second curvature is about 0.5 to 2.0 mm.

16. An image forming apparatus comprising:

developing means for developing a latent image formed on an image bearing member to produce a developed image;

transferring means for transferring said developed image onto a recording medium, wherein said transferring means engages said recording medium while said recording medium is passed between said image bearing member and said transferring means, said transferring means including a plate-shaped transfer member having a support member and a conductive and elastic member supported by said support member;

cleaning means for cleaning said transferring means, said cleaning means including a plurality of projections for contacting said transferring means to remove debris attached to said transferring means; and urging means for urging said plate-shaped transfer member into contact with said image bearing member when said transferring means is operating, and for urging said plate-shaped transfer member into contact with said cleaning means when said transferring means is not operating.

17. An image forming apparatus for forming an image on a recording medium, comprising:

exposure means for forming a latent image on an image bearing member to produce a latent image;

developing means for developing said latent image to produce a developed image;

transfer roller means for transferring said developed image onto said recording medium, said transferring roller means including a conductive and elastic member for engaging said recording medium while said recording medium passes between said image bearing member and said transfer roller means; and cleaning means, contacting said transfer roller means, for cleaning said transfer roller means, said cleaning means having a conductive comb-like member for removing developing agent and paper dust attached to said conductive and elastic member, said conductive comb-like member including a plurality of teeth with spaced portions therebetween, wherein each of said teeth has a top portion having a first curved surface on contacting said conductive and elastic member and each of said spaced portions has a second curved surface for contacting said conductive and elastic member.

18. An image forming apparatus for forming an image on a recording medium, comprising:

exposure means for forming a latent image on an image bearing member to produce a latent image;

developing means for developing said latent image to produce a developed image;

transfer roller means for transferring said developed image onto said recording medium, said transfer roller means including a conductive and elastic member for engaging said recording medium while said recording medium passes between said image bearing member and said transfer roller means;

cleaning means, contacting said transfer roller means, for cleaning said transfer roller means, said cleaning means having a conductive comb-like plate member which includes a plurality of teeth with spaced portions therebetween for removing developing agent and paper dust attached to said conductive and elastic member; and means for reciprocally moving said comb-like plate member along an axial direction of said transfer roller means, wherein the period of reciprocal movement of said comb-like plate member is set to prevent the bending of said conductive and elastic member.

19. An image forming apparatus comprising:

developing means for developing a latent image formed on an image bearing member to produce a developed image;

transferring means for transferring said developed image onto a recording medium, wherein said transferring means engages said recording medium while said recording medium is passed between said image bearing member and said transferring means;

cleaning means for cleaning said transferring means, said cleaning means including a plurality of projecting teeth for contacting said transferring means to remove residual developing agent and paper dust attached to said transferring means;

first means for applying a first bias voltage to said transferring means; and second means for applying a second bias voltage which is approximately 20 to 200 volts higher than said first bias voltage to said cleaning means.

* * * * *